US005311804A

United States Patent [19]

Wilkinson

[11] Patent Number: 5,311,804

[45] Date of Patent: May 17, 1994

[54] LOCKING MECHANISM FOR FLOATING VIBRATO BRIDGE

[76] Inventor: Trevor A. Wilkinson, 1280 Fawnridge Dr., Brea, Calif. 92621

[21] Appl. No.: 6,060

[22] Filed: Jan. 19, 1993

[51] Int. Cl.[5] ..... G10D 3/00

[52] U.S. Cl. ..... 84/313

[58] Field of Search ..... 84/313

[56] References Cited

U.S. PATENT DOCUMENTS

| | | | |
|---|---|---|---|
| 2,972,923 | 2/1961 | Fender | 84/313 |
| 4,638,711 | 1/1987 | Stroh | 84/313 |
| 4,852,448 | 8/1989 | Hennessey | 84/313 |
| 5,088,375 | 2/1992 | Saijo | 84/313 |

*Primary Examiner*—Michael L. Gellner

*Assistant Examiner*—Cassandra C. Spyrou

*Attorney, Agent, or Firm*—Harry G. Weissenberger

[57] ABSTRACT

A vibrato arm mounted on a floating bridge of a string instrument is adapted to engage an anchor seat attached to the body of the instrument, in order to lock the bridge in its centered position when the vibrato arm is parked. When the arm is moved to the play position, a cam arrangement raises the arm out of the anchor seat and frees the bridge for vibrato movement. A single adjustment of the riser on the vibrato arm selects both the desired park position and the vertical engagement position of the arm. The seat-engaging arm end and the seat itself are tapered to guide the arm into centered position. The anchor seat is eccentrically and linearly adjustable for precise centering of the bridge.

7 Claims, 3 Drawing Sheets

LOCKING MECHANISM FOR FLOATING VIBRATO BRIDGE

FIELD OF THE INVENTION

This invention relates to a mechanism for locking a floating vibrato bridge on a guitar or similar string instrument, and more specifically to a mechanism which the vibrato arm itself centers and locks the bridge when it is parked.

BACKGROUND OF THE INVENTION

U.S. Pat. No. 4,638,711 to Stroh discloses a locking mechanism for a floating vibrato bridge, i.e. a bridge which floats in a centered, generally horizontal position on a knife edge support under the opposing forces of the strings on the one hand, and a return spring on the other hand. When desired, a musician can move the bridge back and forth across the centered position by means of a vibrato arm attached to the bridge to produce a vibrato effect.

When no vibrato effect is desired, the bridge needs to be locked in the centered position so as to maintain the correct tuning of the instrument. This is conventionally done by parking the vibrato arm, i.e. pivoting it out of the playing position into a park position in which it locks the bridge.

Prior art devices had several drawbacks: for one, the locking mechanism required a close fit of the interlocking parts and was therefore prone to binding if the bridge was not prefectly centered when the arm was parked; and secondly, mechanisms intended to overcome this drawback were relatively complex and prone to misalignment.

SUMMARY OF THE INVENTION

The present invention provides a simple mechanism in which the vibrato arm, when parked, automatically centers the bridge, and locks it in the centered position. This is accomplished by a cam arrangement which raises the vibrato arm out of locking engagement with the body of the instrument when it is moved into play position, and lowers it into engagement with an anchor fixed with respect to the instrument body when it is moved to the park position. The bottom of the arm is tapered where it engages the anchor, so that if the arm is parked while the bridge is slightly off center, the anchor will automatically guide the vibrato arm into a position where it holds the bridge centered.

DESCRIPTION OF THE PREFERRED EMBODIMENT

Figure 1:
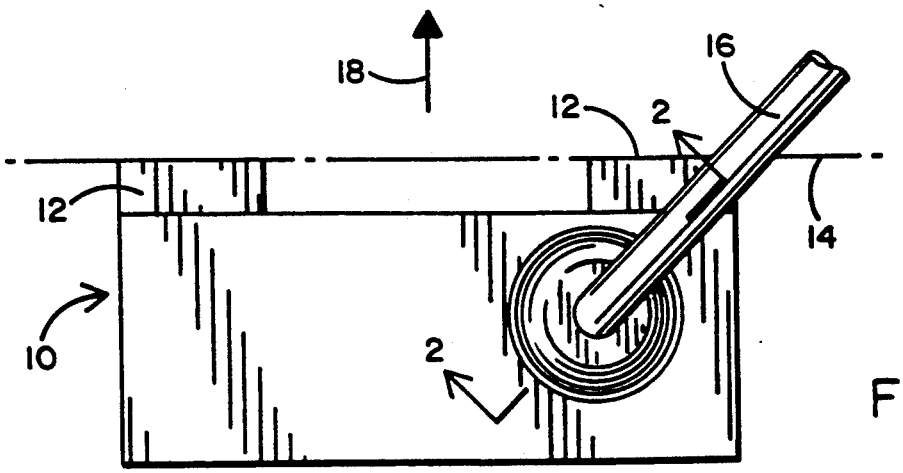
FIG. 1 is a schematic plan view of the bridge with the vibrato arm in the park position.

FIG. 1 schematically shows a conventional floating vibrato bridge 10 on a stringed instrument such as a guitar. The forward side of the bridge 10 ends in a pair of knife edges 12 which bear against an appropriate support (not shown) so as to pivot about a fulcrum axis 14. When the instrument is properly tuned, the string tension and the bias of one or more return springs (not shown) linking the bridge and the instrument body balance each other so that the bridge floats in a position parallel to the instrument body.

In order to produce a vibrato effect, the bridge 10 is provided with a vibrato arm 16 which allows the musician to move the bridge 10 back and forth about the fulcrum axis 14. In normal play, the vibrato arm 16 is swung away from the string direction 18 toward the side of the instrument into the so-called park position shown in FIG. 1. When the vibrato arm is parked, i.e. not in use, the bridge 10 must be locked in its centered position parallel to the instrument body so as to maintain the tuning of the instrument.

Figure 2:
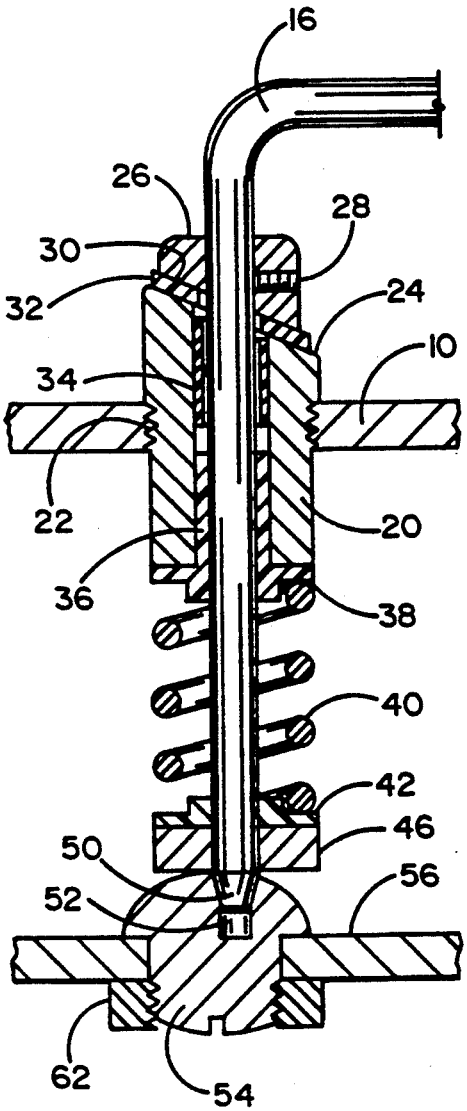
FIG. 2 is a vertical section of the mechanism of this invention with the vibrato arm in the park position.

FIG. 2 illustrates the way in which the centered locking of the bridge is accomplished. The vibrato arm 16 is held in the bridge 10 by a collar 20 which is screwthreadedly affixed to the bridge 10 at 22, and whose upper surface 24 is inclined as shown in FIG. 2. A riser 26 is releasably affixed to the arm 16 by a setscrew 28. The lower surface 30 of the riser 26 is inclined so as to be parallel to the surface 24. A washer 32 preferably made of a lubricating material such as Teflon separates the surfaces 24 and 30.

A bearing insert 34 is positioned inside the collar 20 to guide the arm 16 but leave it free to turn with respect to the collar 20. Below the insert 34, a friction bearing insert 36 may be inserted into the collar 20 and also forms the upper seat 38 for the spring 40. The friction bearing insert 36 engages the arm 16 with just enough friction to prevent the arm 16 from turning under the action of spring 40 acting on the cam formed by surfaces 24 and 30, but can readily move up and down in the collar 20 under the bias of spring 40. This is preferably done so that the arm 16 will not jump back to the park position when it is momentarily released during play.

The spring 40 pushes the lower spring seat 42 away from the seat 38 and thereby urges the arm 16 downwardly in the collar 20. In the park position of FIG. 2, the arm 16 moves downwardly enough to cause its tapered end 50 to engage the tapered anchor seat 52 excentrically formed in the anchor 54. The anchor 54 in turn is fastened to a slotted anchor plate 56 which is attached to the body of the instrument. The seat 52 can be exactly aligned with the center position of bridge 10 by rotating the anchor 54 and/or moving it in the direction of the arrow 58 in the slot 60 of anchor plate 56. A locknut 62 holds the anchor 54 in place once it has been properly aligned.

Figure 3:
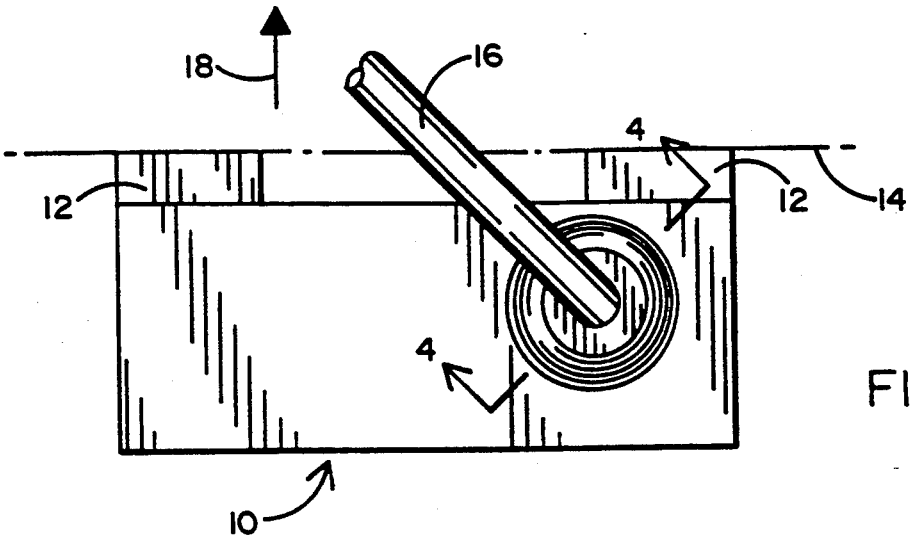
FIG. 3 is a schematic view of the bridge with the vibrato arm in the play position.
Figure 4:
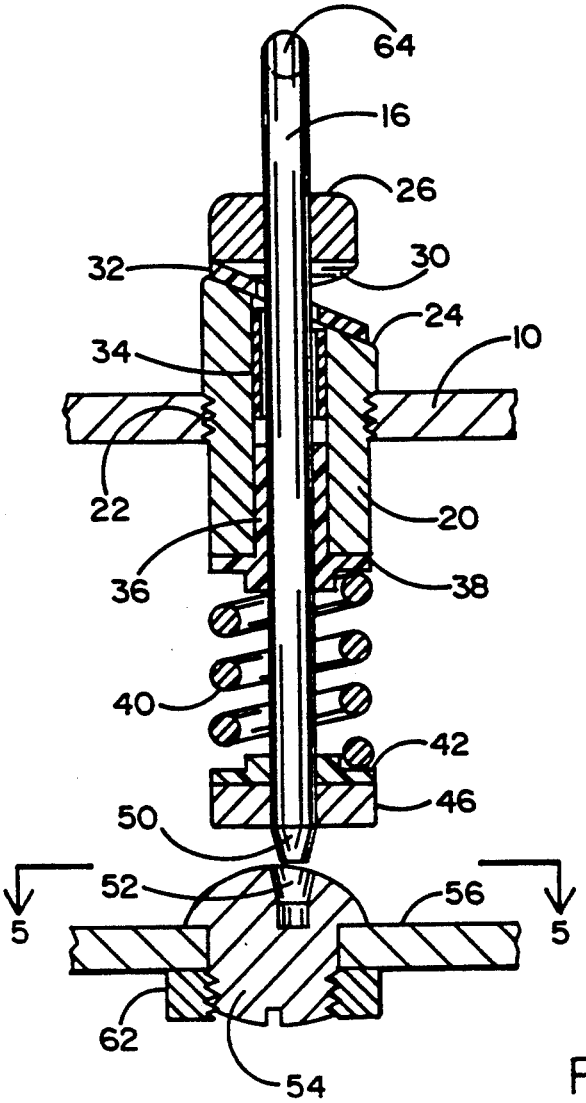
FIG. 4 is a vertical section like FIG. 2 but with the arm in the play position.
Figure 5:
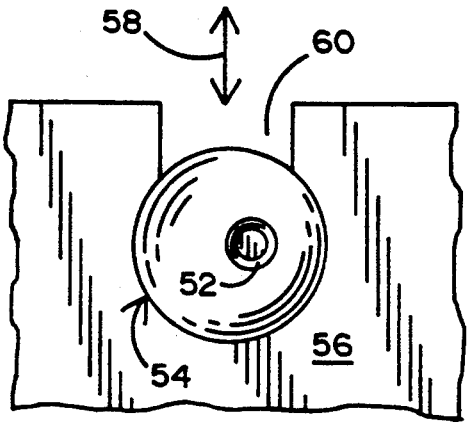
FIG. 5 is a plan view from line 5—5 of FIG. 3.

When the musician desires to produce a vibrato effect, he moves the vibrato arm 16 to the play position shown in FIG. 3. The action of the mechanism in that position is illustrated in FIG. 4. The surface 30 cams up against the washer 32 as the arm 16 is turned. This pulls the arm 16 up against the bias of spring 40 until the tapered end 50 of arm 16 clears the anchor 54 and allows the bridge 10 to be rocked about the fulcrum axis 14 by moving the outer end of the horizontal portion 64 of arm 16 up and down.

Figure 6:
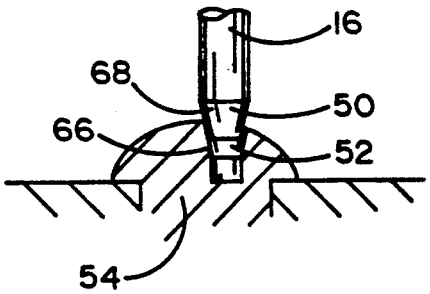
FIG. 6 is an enlarged partial vertical section illustrating the centering action of the mechanism.

FIG. 6 illustrates a particular advantage of the mechanism of this invention. If the bridge 10 is not quite centered when the arm 16 is parked, the surface 66 of the seat 52 will engage the surface 68 of end 50 as the arm 16 comes down and pull it (and bridge 10 with it) into centered alignment.

The installation of the inventive mechanism is as follows:

With the bridge 10 centered, anchor seat 52 is first adjusted so as to be generally coaxial with the opening formed by screwthreads 22 in bridge 10. The assembly comprising the arm 16, riser 26, collar 20, spring 40 and retainer 46 is next passed through the opening in bridge 10 formed by screwthreads 22, and the collar 20 is screwed into bridge 10 as far as it will go. The setscrew 28 is then loosened, and the riser 26 is adjusted rotationally and vertically with respect to the arm 16 so that when the arm 16 is in the desired park position, the surfaces 24 and 30 are parallel, and at the same time the tapered end 50 fully engages the seat 52. Any fine adjustment of the position of seat 52 can now be made. The locknut 62 and setscrew 28 are now tightened, and the device is ready to operate.

I claim:

1. A lockable floating vibrato bridge mechanism, comprising:

a) a string instrument having a body;

b) a vibrato bridge mounted on said body for pivotal movement with respect thereto about a horizontal fulcrum; and c) a locking mechanism for selectively locking said bridge in a predetermined position with respect to said body, said mechanism including:

i) a vibrato arm having a substantially vertical portion mounted on said bridge for rotational movement with respect thereto between a play position and a park position;

ii) a cam assembly interposed between said bridge and said vibrato arm, said cam assembly being arranged to raise said arm with respect to said bridge when said arm is rotated toward the play position, and to allow said arm to be lowered with respect to said bridge when said arm is rotated toward the park position.

iii) an anchor mounted on said body and having a seat positioned so as to engage said vibrato arm when said vibrato arm is lowered into the park position; and iv) a spring interposed between said bridge and vibrato arm, said spring being arranged to so bias said arm as to lower it toward engagement with said anchor.

2. The mechanism of claim 1, in which said vertical portion of said vibrato arm has a tapered lower end, and said anchor seat is also tapered for receiving said tapered arm end.

3. The mechanism of claim 1, further including means for mounting said anchor on said body as to make said anchor rotatably and linearly movable thereon, said seat being eccentrically mounted in said anchor so as to allow alignment of said anchor with said vibrato arm when said bridge is in a predetermined centered position.

4. The mechanism of claim 1, further comprising a friction bearing between said bridge and said vibrato arm, said friction bearing being arranged to allow substantially free vertical movement of said arm in response to said lowering and raising of said arm by said cam and spring, but to sufficiently impede rotary movement of said arm to prevent the arm-lowering bias of said spring from causing said cam to rotate said arm into the park position.

5. The mechanism of claim 1, in which said cam assembly includes a collar fixed to said bridge, said collar having an inclined upper surface, and a riser fixed to said arm, said riser having an inclined lower surface arranged to cammingly interact with said upper surface of said collar.

6. The mechanism of claim 5, in which said riser is rotatably mounted on said arm to allow rotational adjustment of said play and park positions.

7. The mechanism of claim 6, in which said riser is further vertically movably mounted on said arm to allow adjustment of the vertical positioning of said vibrato arm for proper engagement with said anchor in said park position.

* * * * *